US005474359A

United States Patent [19]

Muffi

[11] Patent Number: 5,474,359

[45] Date of Patent: Dec. 12, 1995

[54] SOFA BED WITH INCLINING SEATS

[76] Inventor: James V. Muffi, Rte. 7, Box 399, Tupelo, Miss. 38801

[21] Appl. No.: 54,311

[22] Filed: Apr. 27, 1993

[51] Int. Cl.[6] ..... A47C 17/16; A47C 17/04

[52] U.S. Cl. ..... 297/354.13; 5/41; 297/69; 297/232; 297/423.3

[58] Field of Search ..... 5/37.1, 41, 12.1; 297/69, 232, 354.13, 423.3

[56] References Cited

U.S. PATENT DOCUMENTS

| | | | |
|---|---|---|---|
| 2,170,382 | 8/1939 | Kiesler | 5/37 |
| 2,880,426 | 4/1959 | Goldstein | 5/37 |
| 3,913,152 | 10/1975 | Quackenbush | 5/37 |
| 4,018,166 | 4/1977 | Gutridge et al. | 105/316 |
| 4,311,337 | 1/1982 | Brunn | 297/249 |
| 4,669,135 | 6/1987 | Gonzalez | 5/37 |
| 5,064,244 | 11/1991 | Sproule | 297/68 |

FOREIGN PATENT DOCUMENTS 912392 12/1962 United Kingdom .

*Primary Examiner*—Alexander Grosz
*Attorney, Agent, or Firm*—Phelps Dunbar

[57] ABSTRACT

A sofa or love seat that is convertible to a bed and includes at least one inclining seat section, and optional footrests.

11 Claims, 4 Drawing Sheets

SOFA BED WITH INCLINING SEATS

FIELD OF THE INVENTION

This invention relates generally to sofas or love seats which are convertible into beds, and to sofas or love seats containing inclining seat sections, and more particularly to sofas or love seats that are both convertible into beds and contain inclining seat sections.

BACKGROUND OF THE INVENTION

There exists a continuing demand for multipurpose furniture, both to facilitate efficient use of limited living spaces, and to increase the furniture owner's flexibility in accommodating family and guests. A commonly used method for achieving these goals is to combine, in a single piece of furniture, a sofa and a bed. These products have become known as sofa beds. Sofa beds that convert from sofa to bed through the reclining of the back portion of the sofa until the back portion of the sofa lies in the same plane as the seating surface of the sofa are sometimes referred to as futons or futon beds. In the recent past, furniture producers have increasingly marketed sofas that incorporate motion attributes, such as inclining or reclining seat sections, into the sofa. However, the incorporation of these types of motion attributes into sofas has not heretofore been accomplished in sofa beds and futons. The absence of motion options in sofa beds and futons has limited the demand for such furniture.

SUMMARY OF THE INVENTION

Accordingly, it is the principal object of the present invention to provide a sofa bed of the futon type which includes one or more inclining seat sections as functional components of the furniture when in the upright or sofa position.

A sofa bed of the futon type according to this invention features one or more inclining seat sections, each having a back, seat, and extending footrest. Each of the seat sections may operate independently of the others, and has several different positions, depending upon the extent to which the seat section is inclined. The seat section may be inclined by utilizing any of a variety of controls, including handles or push buttons on the outside arm of the sofa, or pulls located between the cushions of the sofa seat sections, or by a shifting of the occupants' body weight. A further feature of this invention is the ability to convert the sofa into a generally flat surface to facilitate sleeping, by rotating the back portion of the sofa away from the seat portion of the sofa until it is generally in the same plane as the seat portion of the sofa. The foregoing objects, features, and advantages, as well as others will become more apparent in light of the following detailed description and drawings.

DETAILED DESCRIPTION OF THE PREFERRED EMBODIMENT

Figure 1:
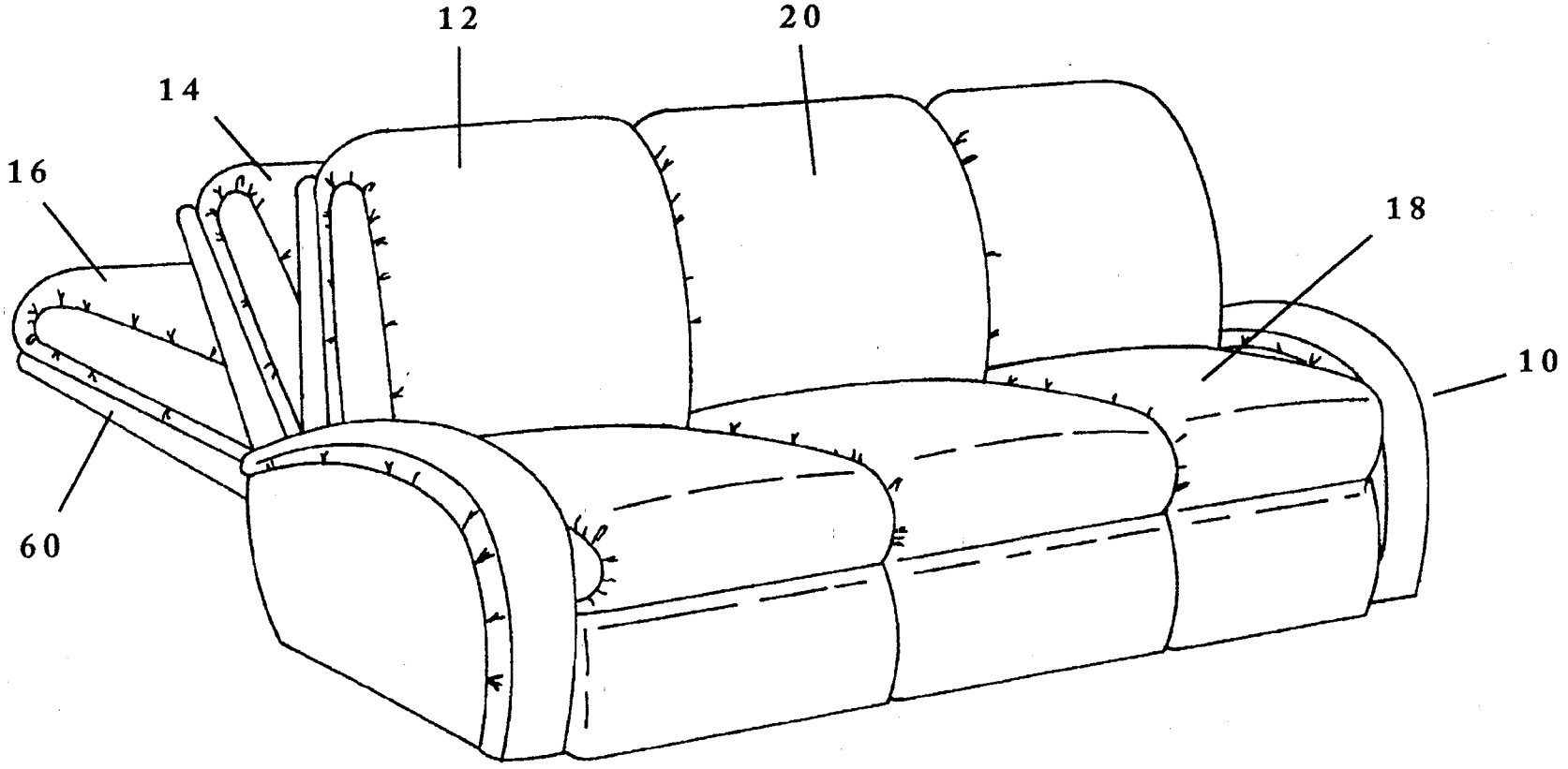
FIG. 1 is a perspective view of a sofa bed of the futon type including two inclining seats, constructed in accordance with this invention, showing the upright, partially inclined, and fully inclined positions of the back portion of the sofa bed.
Figure 2:
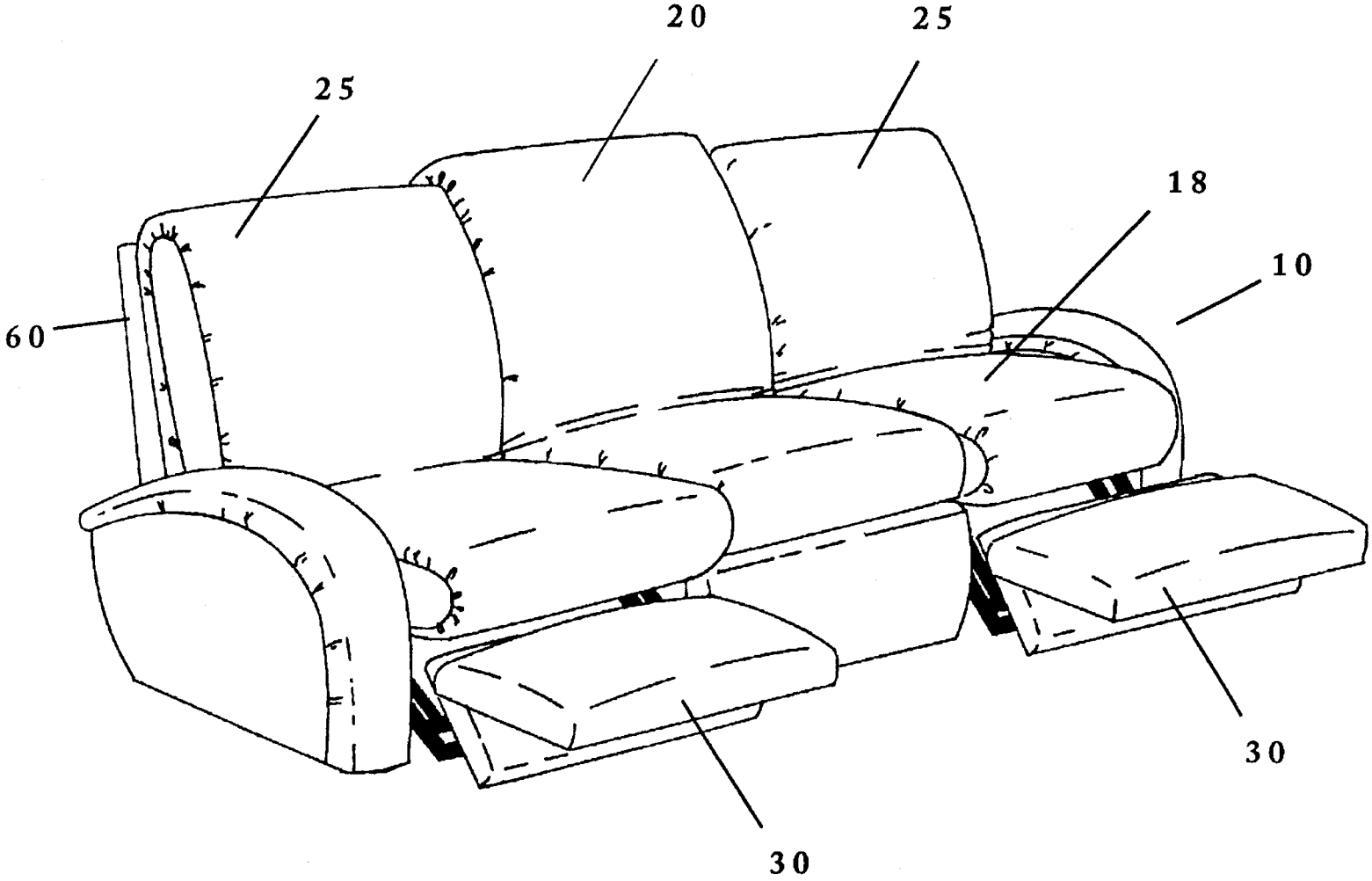
FIG. 2 is a perspective view of a sofa bed of the futon type including two inclining seats, constructed in accordance with this invention, showing the extended footrests of the inclining seats and further showing the inclining seats in a partially inclined position.

FIG. 1 depicts a sofa bed of the futon type 10 in three different positions; the fully upright position 12, the partially inclined position 14, and the fully inclined position 16. The sofa bed of the futon type 10 includes a substantially horizontal seating surface 18 and a back support surface 20, which lie generally in the same plane when the sofa bed 10 is in the fully inclined position 16. The seating surface 18 and back support surface 20 are comprised of a number of independent cushions. The number of cushions in the seating surface 18 is usually equal to the number of cushions in the back support surface 20. Additionally, the number of cushions in the seating surface 18 corresponds to the number of people to be comfortably accommodated on the sofa bed 10. The back support surface 20 rests upon a back portion frame 60, which is a unitary structure extending fully across the back of the sofa bed. FIG. 2 depicts a sofa bed of the futon type 10 with two inclining seat sections 25 with footrests 30. The footrests 30 are shown in the extended position, but may also be retracted into the sofa bed 10 and appear as in FIG. 1. The footrests 30 and the inclining of the seat 25 may be controlled in a variety of manners, including a lever handle on the outside of the sofa arm (not shown) or a push-button device on the outside of the sofa (not shown), or by a pull device which is located between the cushions of the seat sections of the sofa, or by the shifting of the occupants' body weight in the seat.

Although FIG. 1 and FIG. 2 show inclining seats 25 at each end of the sofa bed 10, inclining seats 25 may be located at only one end of the sofa bed 10, or in the middle seat location of the sofa bed 10, or any combination of these locations. A love seat may incorporate the same features. Although not generally long enough to comfortably accommodate an average adult when converted to a bed, a love seat would be of sufficient size to accommodate children when converted to a bed.

Figure 3:
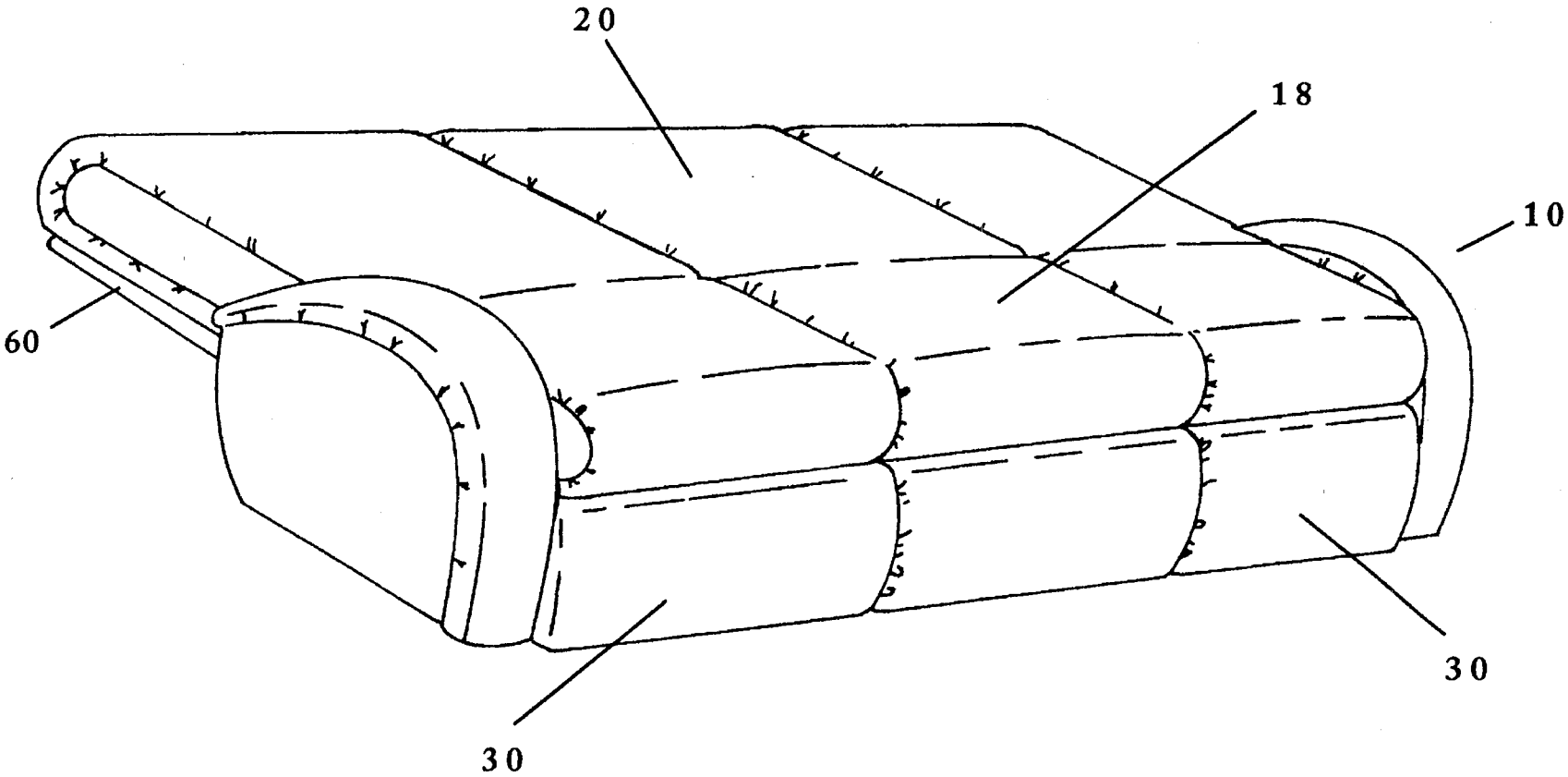
FIG. 3 is a perspective view of a sofa bed of the futon type including two inclining seats, showing the sofa bed in the fully converted bed position.

FIG. 3 shows a sofa bed of the futon type 10 in the fully inclined position. In this position the back portion frame 60 is inclined until it lies in the same general plane as the sofa seat portion 18. Since the back support surface 20 rests upon the back portion frame 60, a sleeping surface comprised of both the back support surface 20 and seating surface 18 of the sofa is formed.

Figure 4:
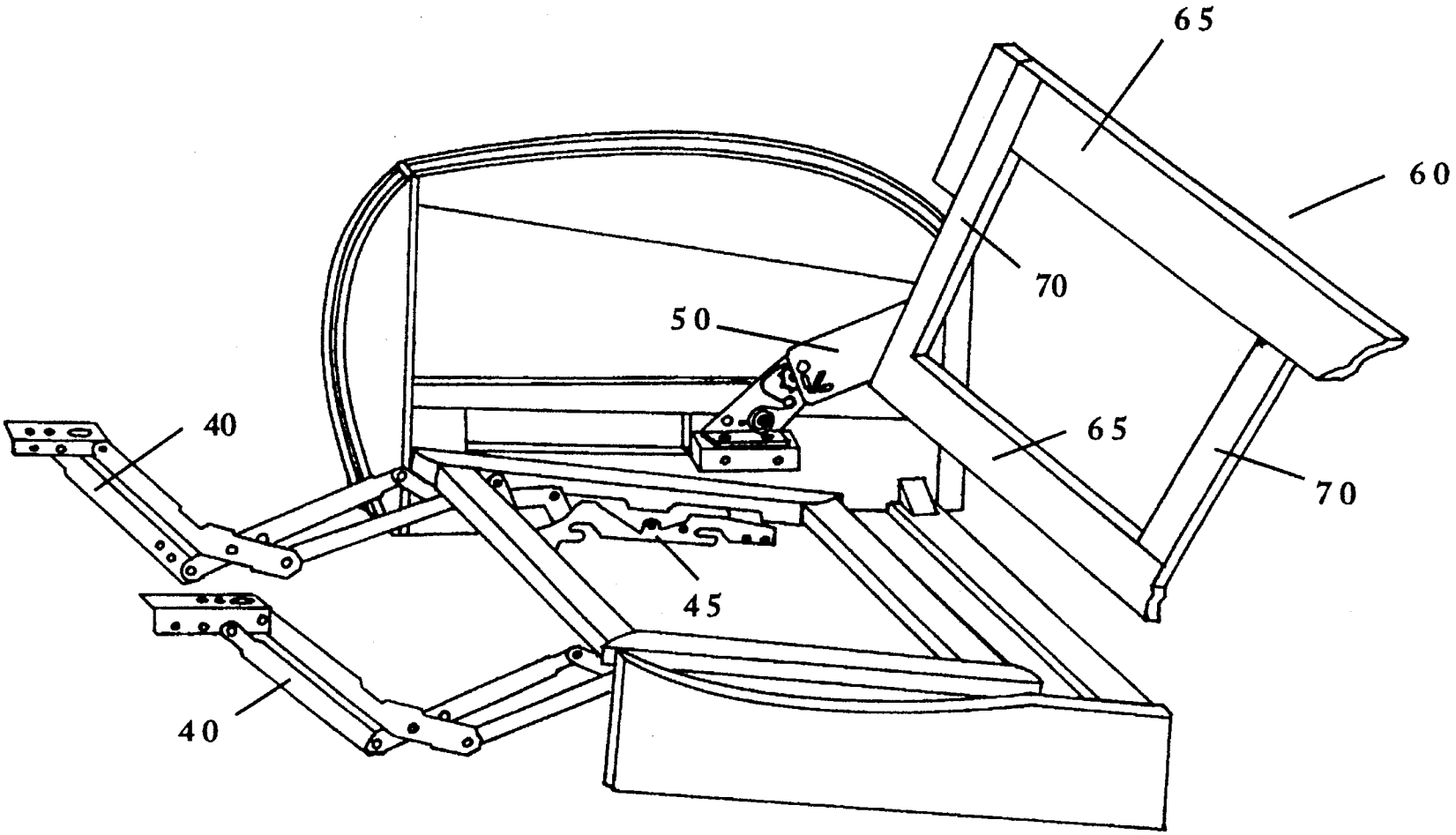
FIG. 4 is a perspective view of the end of a sofa bed of the futon type with an inclining seat, with the upholstery and springs removed showing one form of the mechanism that may be used, with the sofa bed in the fully upright position, and with the footrest extended.

FIG. 4 shows one end of the mechanism of the sofa bed 10. The mechanism may be any one of a variety of mechanisms presently available. The mechanism actually is comprised of two distinct portions, one which operates to incline the back portion frame 60 of the sofa bed 10 and the other which operates the footrest 30 and seating surface 18 of the sofa bed 10. In FIG. 4 the portion of the mechanism which operates to incline the back portion frame 60 of the sofa bed 10 is shown as rachet mechanism 50. A mirror image of rachet mechanism 50 is mounted to the opposite end of the frame of the sofa bed 10. Rachet mechanism 50 is also attached to the back portion frame 60. Back support surface 20 and back portion frame 60, upon which back support surface 20 rests, may be inclined by pulling the back portion frame 60 forward (toward the seating surface 18) slightly, and then rotating the back portion frame 60 away from the seating surface 18 until the desired degree of inclination is obtained. Rachet mechanism 50 is then reengaged by slightly raising the back portion frame 60. Back portion frame 60 is formed of continuous members 65 which extend from one end of the back portion frame 60 to the other end of the back portion frame 60. Brace members 70 extend perpendicularly between continuous members 65. Back support surface 20 rests on back portion frame 60, but is not fixably attached thereto. In this manner each inclining seat 25 may operate independently of the other inclining seats 25, and of other seat sections of the sofa whether inclining or not. When seat section 25 is inclined, seat mechanism 45 causes the seating surface 18 to move forward, which in turn causes back support surface 20 to move downward and forward, which is possible because back support surface 20 only rests upon back portion frame 60, and is not fixably connected thereto. FIG. 2 shows the inclining seats 25 in the partially inclined position. Footrest 30 may be extended or remain in the nonextended position. Footrest mechanism 40 supports and operates footrest 30. The rear surface of back support surface 20 slides across the front surface of back portion frame 60 when the seat section 25 is inclined. Note that both of these surfaces are typically upholstered, which facilitates the sliding motion in a completed sofa bed 10, which is not shown in FIG. 4.

When the sofa bed 10 is converted to the bed position 16, the ratchet mechanism 50 is operated such that the back portion frame 60 is rotated until it is in the same general plane as the seating surface 18. Some sliding of seat back support surface 20 over seat back portion frame 60 may occur when the sofa bed 10 is placed in the fully inclined position 16. One or both arms may be left off of the sofa bed 10 or love seat to facilitate use of the sofa bed 10 or love seat in a sectional furniture arrangement.

It should be understood that the details of the design of the upholstery for the sofa bed 10 are not part of the present invention. From the foregoing detailed description it will be evident that the sofa bed with inclining seats of this invention achieves the objects set forth above. The sofa bed 10 combines the benefits of the sofa-bed combination with motion capable seat sections 25. The preceding is merely a detailed description of the preferred embodiment. Various modifications and equivalents can be made without departing from the spirit or scope of the invention. Therefore, the preceding description is not meant to limit the scope of the invention. The scope of the invention is to be determined by reference to the following claims and equivalents.

What is claimed is:

1. A sofa convertible into a bed comprising:

a substantially horizontal seating surface comprised of a plurality of independent seat cushions, a back support surface comprised of a plurality of independent back cushions, wherein the number of said independent back cushions is equal to the number of said independent seat cushions, a unitary back frame portion supporting said back support surface, movable between upright and inclined positions, said inclined positions including a fully inclined position whereby said unitary back frame portion lies in substantially the same plane as said horizontal seating surface, at least one inclining seat section having a back portion and a seat portion movable between upright and inclined positions, wherein said inclining seat back portion rests movably upon said unitary back frame portion and forms one of said independent back cushions of said back support surface, and said inclining seat section seat portion forms one of said independent seat cushions of said substantially horizontal seating surface.

2. The sofa convertible into a bed as set forth in claim 1 wherein each of said inclining seat sections includes a footrest that may be extended when said inclining seat section is inclined.

3. A love seat convertible into a bed comprising:

a substantially horizontal seating surface comprised of a plurality of independent seat cushions, a back support surface comprised of a plurality of independent back cushions, wherein the number of said independent back cushions is equal to the number of said independent seat cushions, a unitary back frame portion supporting said back support surface, movable between upright and inclined positions, said inclined positions including a fully inclined position whereby said unitary back frame portion lies in substantially the same plane as said horizontal seating surface, at least one inclining seat section having a back portion and a seat portion movable between upright and inclined positions, wherein said inclining seat back portion rests movably upon said unitary back frame portion and forms one of said independent back cushions of said back support surface, and said inclining seat section seat portion forms one of said independent seat cushions of said substantially horizontal seating surface.

4. The love seat convertible into a bed as set forth in claim 3 wherein each of said inclining seat sections includes a footrest that may be extended when said inclining seat section is inclined.

5. The sofa convertible into a bed as set forth in claim 1 wherein said inclining seat sections are located at each end of said sofa.

6. The sofa convertible into a bed as set forth in claim 1 wherein said inclining seat sections include control means, one for each said inclining seat section, which when activated cause said inclining seat section to move from the upright to the inclined position.

7. The sofa convertible into a bed as set forth in claim 2 wherein each of said footrests include control means, which when activated cause said footrest to move from the unextended to the extended position.

8. The sofa convertible into a bed as set forth in claim 1 wherein said sofa is without an arm at one end whereby other pieces of furniture may be placed in an abutting relationship with said sofa.

9. The love seat convertible into a bed as set forth in claim 3 wherein said inclining seat sections include control means, one for each said inclining seat section, which when activated cause said inclining seat section to move from the upright to the inclined position.

10. The love seat convertible into a bed as set forth in claim 4 wherein each of said footrests include control means, which when activated cause said footrest to move from the unextended to the extended position.

11. The love seat convertible into a bed as set forth in claim 3 wherein said love seat is without an arm at one end whereby other pieces of furniture may be placed in an abutting relationship with said love seat.

* * * * *